United States Patent [19]

Nezworski et al.

[11] 4,350,273

[45] Sep. 21, 1982

[54] PORTABLE KEG TAPPING COUPLER

[75] Inventors: James E. Nezworski, Waukesha; John M. Strobel, West Allis, both of Wis.

[73] Assignee: The Perlick Company, Inc., Milwaukee, Wis.

[21] Appl. No.: 163,782

[22] Filed: Jun. 27, 1980

[51] Int. Cl.[3] ..... B65D 83/14

[52] U.S. Cl. ..... 222/400.8; 222/400.7; 137/212; 137/322

[58] Field of Search ..... 222/400.8, 400.7, 401, 222/402, 209; 137/212, 322; 417/511

[56] References Cited

U.S. PATENT DOCUMENTS

| | | | |
|---|---|---|---|
| 3,224,378 | 12/1965 | Graham | 417/511 |
| 3,720,355 | 3/1973 | Johnston | 222/400.8 X |
| 3,908,861 | 9/1975 | Johnston | 222/400.7 X |
| 4,095,727 | 6/1978 | Dorsch | 222/400.8 |
| 4,119,244 | 10/1978 | Funke | 222/400.8 |

FOREIGN PATENT DOCUMENTS

| | | | |
|---|---|---|---|
| 709717 | 5/1965 | Canada | 222/400.7 |
| 1333043 | 10/1973 | United Kingdom | 222/400.7 |

*Primary Examiner*—Charles A. Marmor

*Attorney, Agent, or Firm*—James R. Custin; James E. Nilles

[57] ABSTRACT

A portable key tapping unit for a keg having a conventional valve assembly comprises concentric inner and outer body members, the latter cooperable with lugs on the keg to provide a bayonet connection. A small diameter lower portion of the inner body member is surrounded by the outer body member and has a cam connection therewith. A concentric larger diameter upper portion of the inner body member comprises a cylindrical upwardly opening pump chamber wherein an upwardly biased plunger is reciprocable vertically. A liquid passage in the inner body member has a concentric inlet at the bottom thereof and opens laterally to one side of it. A vertical gas passage through the inner body member, spaced from its axis, opens downwardly to its bottom and upwardly to the pump chamber. An elastic ring confined between the body members provides a gas seal between them and also serves to transmit limited torque from the inner to the outer body member so that a rotational movement in one direction of the inner body member establishes the bayonet connection with the keg and thereafter effects downward movement of the inner body member to its position in which it holds open the valves of the keg assembly.

10 Claims, 5 Drawing Figures

PORTABLE KEG TAPPING COUPLER

FIELD OF THE INVENTION

This invention relates to a portable coupler or tapping unit for valved kegs, which coupler is particularly suitable for occasional use, as at picnics or parties; and the invention is more particularly concerned with a portable coupler or tapping unit that comprises a hand pump for pressurizing the keg to which the unit is coupled.

BACKGROUND OF THE INVENTION

In the widely used keg tapping systems of the type to which the present invention generally relates, each keg is fitted with a keg unit that is seated in its bung hole and comprises normally closed valves that are opened by installation on the keg of a coupler or tapping unit. The keg installation defines an upwardly opening well in which the coupler or tapping unit is receivable, and the bottom of the well is defined by an annular gas valve seat, a concentric annular gas valve which is biased upwardly for engagement with the gas valve seat and which itself defines a liquid valve seat, and a central poppet-like liquid valve that is biased upwardly for engagement with the liquid valve seat. When the keg is tapped, beer flows up to the liquid valve through a siphon tube which extends down to near the bottom of the keg, being forced up the siphon tube by pressure gas filled into the keg past the open gas valve.

A coupler or tapping unit to be coupled to the keg conventionally has a substantially annular outer body member that is received in the well and makes a bayonet connection with lugs on the keg that project radially into the well near its top. When that bayonet connection is established, a radially inner body member of the coupler is moved down to open the gas and liquid valves in the keg and thus communicate the interior of the keg with gas and liquid passages in the coupler.

In a tavern installation, the liquid passage in the coupler is more or less permanently connected with a duct that leads to a beer tap at the bar, while the gas passage in the coupler is connected with a source of pressure gas (usually a bottle of compressed carbon dioxide) from which the interior of the keg is pressurized. The tavern installation coupler includes a valve in its gas passage that is closed when the inner member is in its raised position and is opened when the inner member is moved down to open the gas and liquid valves in the keg. This valve in the coupler unit gas passage prevents loss of pressure gas from the source thereof during the time that the coupler is being transferred from one keg to another.

In the usual tavern coupler, the inlet to the gas passage comprises a spout-like nipple that is formed on the coupler body and projects laterally to one side of it, while the liquid passage opens to a concentric upwardly projecting nipple on the top of the coupler body. Normally, the gas hose and the duct that leads to the beer tap are respectively connected to these nipples.

When keg beer is purchased for consumption at a party or picnic, it is delivered in a keg having a valve installation identical to the one in a keg delivered to a tavern, and the purchaser must therefore arrange for use of a coupler or tapping unit in order to be able to dispense the beer from the keg. On such an occasion it is obviously impractical to provide a bottle of pressure gas, along with the plumbing and pressure control valves that are normally incorporated in the pressure gas system of a tavern installation, and therefore the keg is pressurized by means of a hand pump.

It has been generally customary for the purchaser of keg beer for occasional use to rent a coupler for the occasion, usually from the dealer from whom the keg beer was purchased. Heretofore the so-called picnic couplers that have been made available for this purpose have been tavern units that were more or less modified for connection with a hand pump.

In some cases the hand pump had a rigid threaded connection directly to the gas line nipple on the coupler body, and it projected sidewardly from the coupler, coaxially with that nipple. Such an installation, although relatively convenient and inexpensive, had the significant disadvantage that the pump acted as a lever by which very large upward bending forces could be exerted upon the bayonet connection lugs that projected into the coupler well in the keg. It often happened that these lugs were bent up during use of a picnic coupler. Sometimes their deformation was not noticed when the keg was returned to the brewery, and the defective keg was unwittingly delivered to a purchaser who found himself unable to tap it.

To avoid the possibility of such damage to cooperage some picnic couplers have been furnished with a separate hand pump that was mounted on the tapped keg by means of a special bracket and was connected to the gas passage nipple of the coupler unit by means of a hose or the like. Provision of such an assembly of course involved the cost of the bracket and the hose in addition to the rather substantial cost of the hand pump and the coupler unit.

A third type of heretofore conventional picnic coupler, likewise relatively expensive, was one wherein an elongated device that projected coaxially up from the top of the coupler comprised a hand pump that was more or less integrated with a laterally projecting liquid dispensing outlet near its top. Although offering less possibility for damaging the keg lugs than the laterally projecting pump, substantial lug-deforming leverage could nevertheless be exerted at the upper end of this vertical pump, and the location and orientation of the pump were such that it was somewhat inconvenient to operate.

Whatever its functional advantages and disadvantages, all of this prior picnic coupler equipment posed an economic problem which has always been significant but which has become increasingly severe in recent years. The modified tavern coupler and the hand pump associated with it constituted a package which cost substantially more than the amount of any deposit on it that users could reasonably be expected to pay. Knowing that the equipment was worth more than the deposit, users have often deliberately failed to return the equipment and forfeited the deposit.

Since a beer depot cannot sell keg beer if it requires the purchaser to pay an extremely high deposit on picnic coupler equipment, and it cannot afford to sell keg beer if there are going to be losses from time to time on unreturned equipment, many beer depots have simply stopped selling keg beer.

In addition to the obvious economic detriment to beer depots and breweries, the lack of an inexpensive but satisfactory picnic coupler has resulted in some loss of what is, for many, one of the genuine pleasures of life. Thus the problems posed by the need for a satisfactory picnic coupler have such widespread and substantial impact that if there had been any obvious solution to them, that solution would undoubtedly have come forth long ago.

SUMMARY OF THE INVENTION

The general object of the present invention is to provide a portable tapping unit or picnic coupler for keg tapping systems of the character described, constituting a single compact unit that comprises both the coupler itself and a very convenient and easily operated hand pump, which picnic coupler is capable of being manufactured and profitably sold at a price substantially lower than the inadequate deposits heretofore customarily demanded for picnic couplers comprising adapted tavern units.

Another and very important object of this invention is to provide a simple, sturdy, convenient and very inexpensive picnic coupler which is so compact that it offers practically no possibility of bending or deforming bayonet connection lugs on a keg on which it is installed, and which cannot otherwise damage the keg.

It is also an important object of this invention to provide a picnic coupler which is unusually easy to install on a keg and which is therefore especially suitable for use by persons who tap beer kegs only infrequently. More specifically, in this connection, it is an object of the invention to provide a picnic coupler which comprises a relatively large diameter, knob-like pump body that is nicely suited to be grasped for imparting bodily rotation to the coupler, and with which tapping of a keg is accomplished by a simple rotational motion of said pump body in one direction, to thereby first effect establishment of a bayonet connection between the coupler and the keg and thereafter effect opening of the gas valve and the liquid valve in the keg.

Another specific object of the invention is to provide a picnic coupler of the character described having a hand pump which is so arranged as to be very conveninently operable by flatwise up and down motion of the palm of the hand but which is further so arranged that overpressurization of a key on which the coupler is installed is so difficult as to be very unlikely in practice.

A further specific object of the invention is to provide a coupler of the character described comprising a substantially annular outer body member that provides for a bayonet connection between the coupler and a keg, and a substantially concentric inner body member which has a cam connection with the outer body member whereby the inner body member is moved down to a valve unseating position in consequence of its rotation in one direction relative to the outer body member, said coupler being characterized by an elastic sealing ring that is confined between the body members to provide a gas seal between them and to serve for transmitting limited torque from the inner member to the outer member whereby a rotational movement of said inner body member in said one direction can cause said bayonet connection to be established and thereafter cause the inner body member to move down to its valve unseating position.

These objects of the invention are achieved in a keg tapping unit which cooperates with a keg that has an upwardly opening well, lugs projecting radially into said well near the top thereof, an annular gas valve seat at the bottom of said well, an annular gas valve which is biased upwardly for engagement with said gas valve seat and which itself provides a liquid valve seat, and a concentric liquid valve which is biased upwardly for engagement with said liquid valve seat. The tapping unit of this invention is of the general type that comprises substantially concentric inner and outer body members, the outer body member being receivable in said well and cooperable with said lugs to provide a bayonet connection with the keg, and the inner body member being movable downward and upward relative to the inner body member, respectively to and from a position in which the inner body member maintains said gas valve and said liquid valve unseated. The keg tapping unit of this invention is characterized by said inner body member having a lower portion that is received in the outer body member and an upper portion which comprises an upwardly opening pump chamber above the outer body member and which is of substantially larger diameter than said lower portion and substantially concentric with the same. A plunger is reciprocable up and down in said pump chamber and is biased upwardly. The lower portion of the inner body member has therein a liquid passage which opens concentrically to the bottom thereof and laterally to one side thereof and a gas passage which opens to the bottom thereof in laterally spaced relation to said liquid passage and opens upwardly to said pump chamber. A check valve in the gas passage allows air to flow downwardly therethrough from the pump chamber.

Preferably there are cooperating cam means on the outer body member and on the lower portion of the inner body member whereby the inner body member is moved down to its above-mentioned position in consequence of its rotation in one direction relative to the outer body member; and an elastic sealing ring confined under radial compression between the inner and outer body members provides a gas seal between them and a connection through which limited torque is transmitted and which thus enables said bayonet connection to be established and the inner body member to be subsequently moved to its said position by a rotational movement of the inner body member in said direction.

It is also preferred that said cam means be arranged to define a detent as the inner body member arrives at its said position, so that the inner body member has no tendency to be rotated and moved out of that position in consequence of actuation of the plunger.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT OF THE INVENTION

Figure 2:
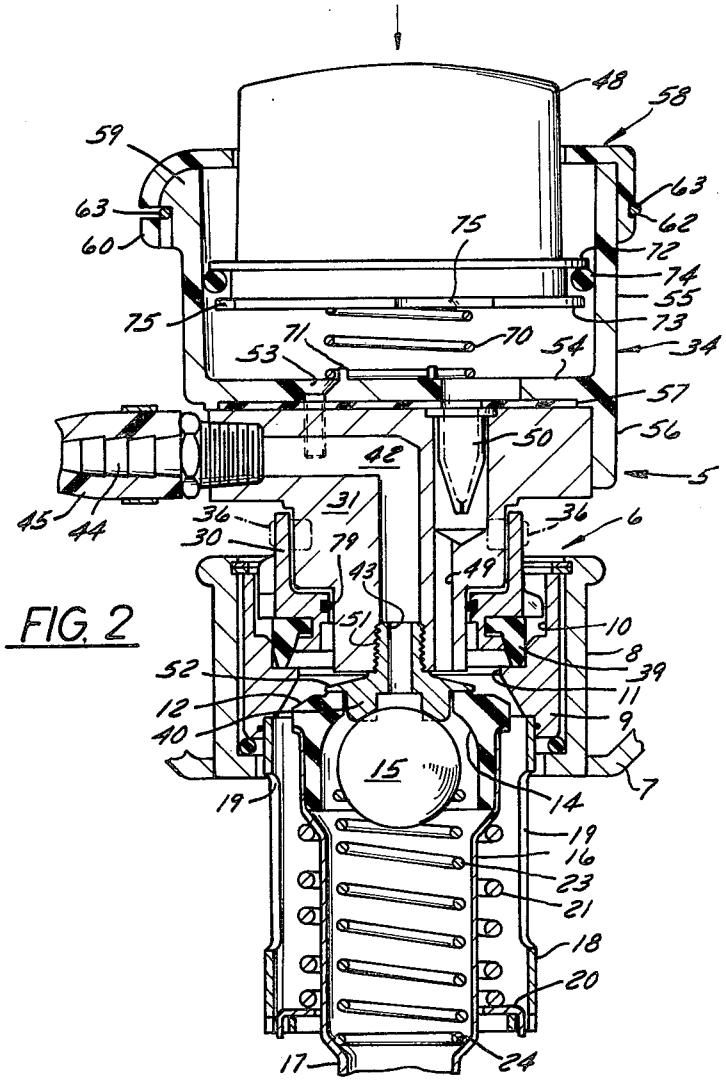
FIG. 2 is a view in vertical section of the picnic coupler, installed on a keg and in its condition that provides for pressurizing the keg and drawing beer from it.
Figure 1:
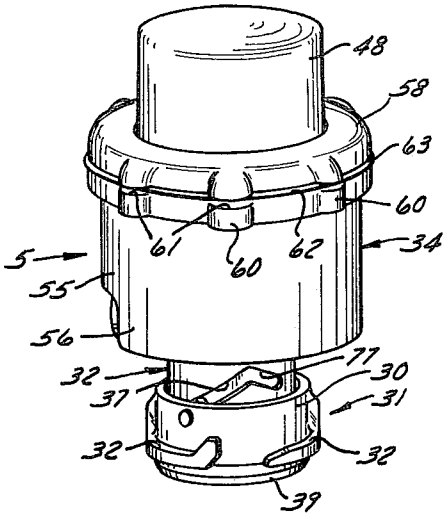
FIG. 1 is a view in side perspective of a portable tapping unit or picnic coupler that embodies the principles of this invention.

In the accompanying drawings, the numeral 5 designates generally a portable keg tapping unit or picnic coupler embodying the principles of this invention, intended for cooperation with a keg valve unit 6 of a conventional type, installed in a keg 7.

The keg 7 is made with a cylindrical neck 8 which constitutes its bung hole and in which a body portion 9 of the keg valve unit 6 is received. In its cooperation with the keg neck 8, the body 9 of the keg unit 6 defines an upwardly opening well 10, the bottom of which is in part defined by an annular gas valve seat 11. An annular gas valve 12, biased upwardly for engagement with the gas valve seat 11, itself defines a liquid valve seat 14 that is engageable by an upwardly biased concentric liquid valve 15. The gas valve 12 and the liquid valve 15 are closed when the keg is not tapped, and the top surfaces of these valves 12 and 15 and of the gas valve seat 11, which are then substantially coplanar, define the bottom of the well 10.

The annular gas valve 12 has a tubular stem portion 16 within which the liquid valve 15 is movable up and down. A downward extension 17 of this stem portion 16, which terminates near the bottom of the keg, comprises a siphon tube through which liquid can be brought up out of the keg to the picnic coupler 5. The liquid is forced up into the siphon tube 17 by pressure gas which can be introduced into the top of the keg when the gas valve 12 is open. The keg unit body 9 has a tubular downward extension 18 that projects below the keg neck 8 and surrounds the gas valve stem 16 to cooperate with it in defining an annular gas passage that has large laterally opening outlet ports 19 through which pressure gas can be charged into the keg. The bottom end of the tubular extension 18 comprises an annular upwardly facing spring seat 20 that supports a coiled expansion spring 21 whereby the gas valve 12 is biased upward towards its seat 11. Another coiled expansion spring 23 is seated on a shoulder 24 in the gas valve stem 16 and reacts against the liquid valve 15 to bias it upwardly towards its closed position.

The picnic coupler 5 comprises, in general, a substantially annular outer body member 30, which provides for releasably locking the picnic coupler to a keg, and an inner body member 31, which serves to maintain the gas valve 12 and the liquid valve 15 unseated when the coupler is fully installed on a keg.

Figure 5:
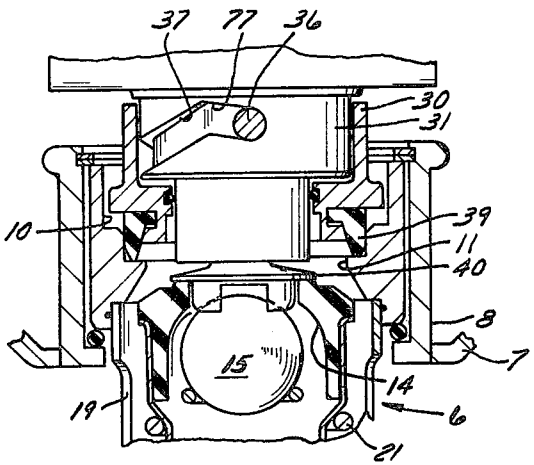
FIG. 5 is a view generally similar to FIG. 4, but with portions of the picnic coupler also shown broken away and with the inner body member of the picnic coupler in its valve-unseating position.
Figure 3:
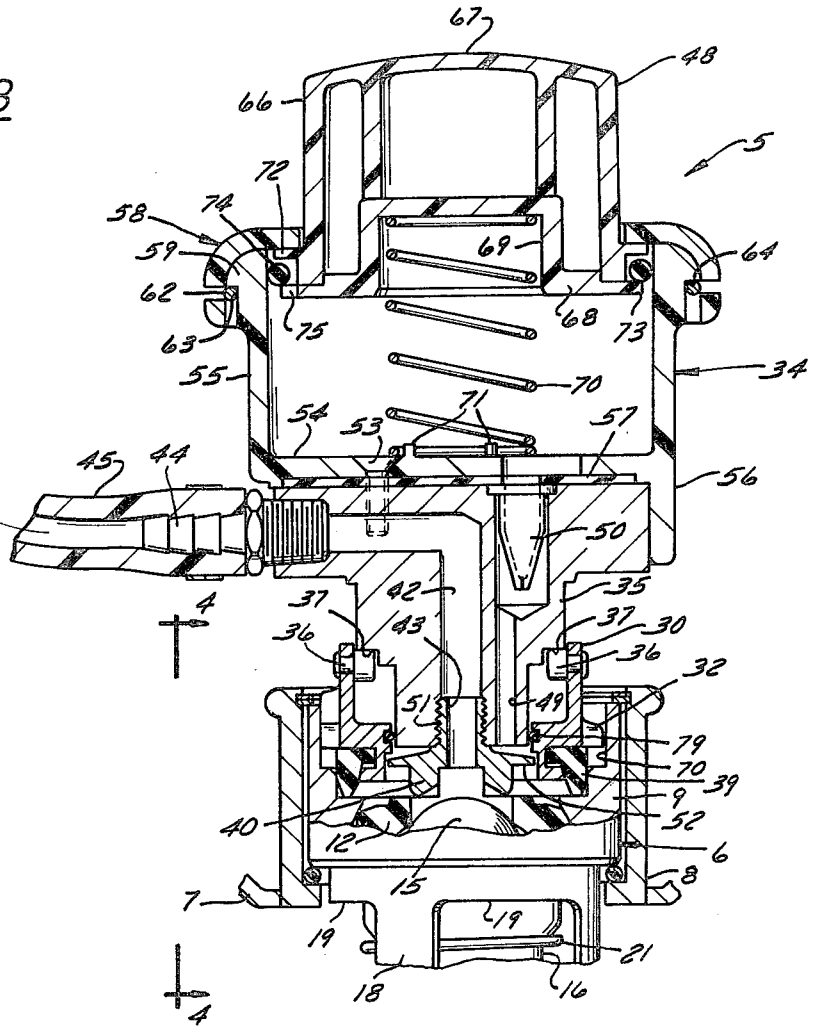
FIG. 3 is a view generally similar to FIG. 2 but showing the picnic coupler in a preliminary stage of its connection to the keg, wherein its bayonet connection with the keg is established but its inner body member has not yet been moved down to the valve-unseating position.
Figure 4:
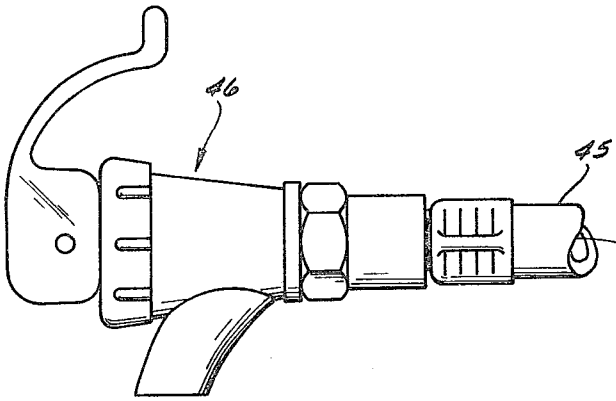
FIG. 4 is a fragmentary view mainly in side elevation but with portions of the keg assembly shown broken away, taken in the direction designated by the arrows 4—4 in FIG. 3.
Figure 4:
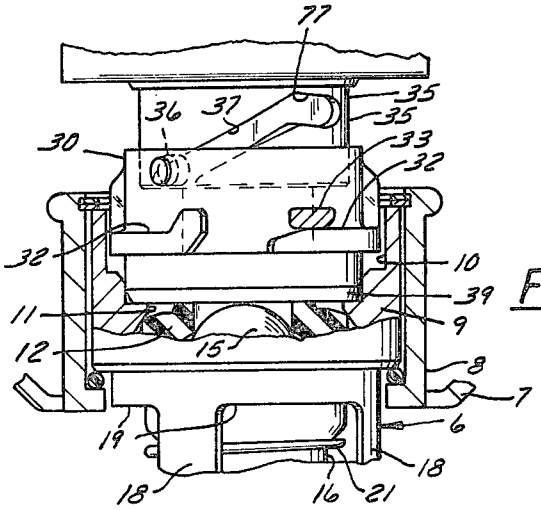

The coupler 5 is locked to the keg upon establishment of a bayonet connection between flanges 32 on the exterior of the outer body member 30, each extending partway around it, and more or less standard lugs 33 on the keg unit, projecting radially into the well 10 near the top thereof. The inner body member 31 has an upper portion of relatively large diameter that comprises a cylindrical upwardly opening pump chamber 34, and it has a coaxial, smaller diameter lower portion 35 that is surrounded by the outer body member 30 and is rotatable and axially slidable relative to it. There is a cam connection between the body members 30, 31, comprising radially inwardly projecting cam follower lugs 36 on the outer body member 30, engaged in cam grooves 37 in the cylindrical surface of the inner body member 31 that extend circumferentially at a spiral inclination in one axial direction. By this cam connection, rotation of the inner body member 31 in one direction relative to the outer body member 30 is translated into downward motion of the inner body member 31 to a valve-unseating position, in which it is shown in FIGS. 2 and 5.

The bottom of the outer body member 30 comprises an elastic sealing ring 39, and establishment of the bayonet connection 32, 33 disposes that sealing ring in firm sealing engagement with the upper surface of the annular gas valve seat 11 in the keg unit, to provide a gas seal all around the connection between the keg unit 6 and the coupler 5.

With the bayonet connection 32, 33 established, rotation of the inner body member 31 relative to the outer body member 30 brings the inner body member 31 down to its valve unseating position wherein a probe portion 40 on its bottom holds open the gas valve 12 and the liquid valve 15.

The liquid that flows up past the liquid valve 15 from the siphon tube 17 enters a liquid passage 42 in the inner body member 31. The inlet 43 to this liquid passage 42 is in the probe portion 40 and is thus at the bottom of the inner body member 31 and concentric to it. The outlet end portion of the liquid passage 42, which can be threaded to receive a hose nipple 44, is in the large diameter upper portion of the inner body member 31 and opens laterally to one side of it. A beverage hose 45 can have one of its ends connected to the nipple 44 and can have at its other end a suitable dispensing valve 46. It will be apparent that the liquid passage 42 in the inner body member 31 can be defined by intersecting bores, one of them drilled coaxially upwardly from its bottom, the other drilled radially inwardly from one side of it.

As more fully described hereinafter, a plunger 48 is manually reciprocable in the pump chamber 34 that comprises the upper portion of the inner body member 31, providing a pump whereby pressure air can be forced down through a gas passage 49 in the inner body member and thus past the open gas valve 12 of the keg unit and into the keg. The gas passage 49, which extends substantially vertically through the inner body member 31, opens to the bottom of that body member in laterally spaced relation to the inlet 43 of the liquid passage 42. At its upper end the gas passage 49 opens upwardly into the pump chamber 34. The upper portion of the gas passage 49 is of enlarged diameter to accommodate a duck-bill check valve 50 which permits downward flow of air but prevents upward flow.

The probe portion 40 at the bottom of the inner body member 31, as is generally conventional in coupler units, can be made as a separate part, of inverted mushroom shape. Its tubular stem 51 is externally threaded to be received in a correspondingly threaded counterbore in the lower portion of the liquid passage 42. Its head 52 is formed to make sealing engagement with the annular gas valve 12, all around the same, as it holds the gas valve down off of its seat, thereby sealing off the gas perhaps 49 from the effectively continuous liquid passage that comprises the keg unit gas valve stem 16 and the liquid passage 42 in the inner body member 31. A reduced diameter portion of the head 52, at its underside and across which there is a downwardly opening diametral slot, holds the liquid valve 15 off its seat. It will be noted that the head portion 52 of the probe 40, which has a frustoconical upper surface, underlies but is downwardly spaced from the outlet of the gas passage 49 in the inner body member 31.

The pump chamber 34 that comprises the upper portion of the inner body member 31 is preferably made as a cup-shaped plastic molding. Screws 53 extend down through its bottom wall 54 and are threaded into the metal part of the inner body member 31 for a rigid connection between those parts. The cylindrical side wall 55 of the plastic molding extends downwardly a distance below its bottom wall 54 to form a skirt 56 which fits closely around the metal portion of the inner body member to cooperate with the screws 53 in firmly anchoring the plastic pump chamber part 34 to the metal part. A gasket 57 is preferably confined between the bottom wall 54 of the pump chamber part and the flat top surface of the metal part, to provide a gas seal at the registering holes in them that define the gas passage 49.

An annular collar-like cap member 58 fits over the rim of the pump chamber side wall 55, surrounding the plunger 48 with some clearance to guide the plunger in its reciprocating motion, and providing a closure for an annular space between said side wall 55 and the cylindrical body of the plunger. Near its top the cylindrical side wall 55 of the pump chamber has a series of circumferentially spaced, radially outwardly projecting lobe-like protuberances 59, and the downwardly projecting side wall portion of the cap is formed with bulges 60 that define inwardly opening bays wherein the lobe-like protuberances 59 on the pump chamber side wall 55 are closely received to confine the cap against rotation relative to the rest of the inner body member 31. There is a circumferentially extending slot 61 in each of the bulges 60 in the cap member, and these slots 61 align with radially outwardly opening groove segments 62 that extend circumferentially around the unbulged portions of the cap side wall 55, so that the slots 61 and the groove segments 62 together define a continuous circumferential recess in which a spring snap ring 63 is closely receivable. The snap ring 63 releasably locks the cap 58 to the inner body member 31, inasmuch as each of the lobe-like protuberances 59 on the cylindrical side wall 55 of the pump chamber has a downwardly facing shoulder 64 under which the snap ring 63 engages when it is seated in the recess 61, 62.

The plunger 48 of the air pump is preferably made in two parts, both of which can be plastic moldings. One of these is a substantially cup-shaped outer part that comprises the cylindrical side wall 66 of the plunger and its upper end wall 67; the other is an inner part 68 that defines a bottom wall for the plunger wherein there is a downwardly opening concentric well 69. A coiled compression spring 70 by which the plunger 48 biased upwardly has its upper end portion received in the well 69 and has its bottom end engaged against the bottom wall 54 of the cup-shaped pump chamber part, where it is held in concentric relation to the plunger and the pump chamber by upwardly projecting protuberances 71 that can be formed integrally with said bottom wall 54.

As shown, the plunger 48 has upper and lower radially outwardly projecting circumferential lands 72, 73 on its cylindrical side wall 66, near the bottom thereof, between which an O-ring 74 is confined. Each of these lands 72, 73 is of such outside diameter as to have a rather substantial clearance from the inside surface of the pump chamber side wall 55, but the upper land 72 has a large enough outside diameter to engage the cap member 58 to define the fully raised position of the plunger.

The axial distance between the lands 72, 73 is somewhat greater than the cross-section diameter of the O-ring 74, so that the O-ring can have some axial up and down motion between the lands. The O-ring 74 has an inside diameter large enough to afford a substantial radial clearance between it and the cylindrical surface of the plunger 48, but its outside diameter is slightly greater than the inside diameter of the pump chamber side wall 55 to ensure that it has good sealing engagement with that wall. The lower land 73 has circumferentially spaced, radially deep cutouts 75 so that, in effect, it has circumferential discontinuities; and these cut-outs 75, in cooperation with the above-mentioned clearances, enable the O-ring 74 to function both as a sliding seal for the air pump plunger 48 and as a check valve element that allows air to be drawn into the pump chamber 34 as the plunger moves up but prevents it from escaping as the plunger is depressed.

As the plunger moves down, the drag of the O-ring 74 against the pump chamber side wall 55 maintains the O-ring sealingly engaged with the circumferentially continuous upper land 72 as well as with said side wall 55, preventing escape of air from the upper portion of the pump chamber 34 and thus compelling the air that has been pressurized by the descending plunger to flow down through the duck-bill check valve 50 and the gas passage 49. As the plunger rises under bias of the spring 70, the O-ring 74 engages the lower land 73. Air can then be drawn into the pump chamber through the fairly large clearance between the annular cap 58 and the cylindrical surface of the plunger, through the clearance between the upper land 72 and the pump chamber wall 55, over the O-ring 74 and down through the annular space between it and the plunger, and then further down into the pump chamber through the cutouts 75 in the lower land 73.

Because the plunger 48 has a relatively large diameter and short stroke, and because it is biased upward, it can be very easily actuated with a flatwise motion of the palm of the hand, and the low overall height of the picnic coupler 5 assures that this mode of operation will be very convenient. Furthermore, the large cross-section area of the plunger 48 ensures that when pressure in the keg becomes higher than necessary, there will be a substantial force on the plunger that resists its downward motion and discourages further pumping, so that overpressurization of the keg is very unlikely to occur.

It will be observed that no undue forces are imposed upon the bayonet connection lugs 33 of the keg through the picnic coupler 5 of this invention, owing to its low overall height and the fact that only vertically downward forces are applied to it during pump operation.

As the pump is operated, there could be a tendency for the inner body member 31 to be rotated relative to the outer body member 30 in the direction to raise the inner body member 31 out of its valve-unseating position. To prevent such inadvertent displacement, the cam grooves 37 in the inner body member have a very slght (e.g. 5°) downward inclination, as at 77, whereby a detent is defined as the inner body member 31 reaches the position of its rotation that corresponds to its valve unseating position. The biasing force for actuating this detent is of course provided by the valve springs 21 and 23, acting through the gas valve 12 and the liquid valve 15 in their engagement against the bottom of the inner body member 31.

Since the inner body member 31 must have an easy movable fit within the annular outer body member 30, the clearance space between the body members must be sealed to prevent the escape of pressure gas. The necessary seal is provided by an O-ring 79 that snugly surrounds the cylindrical and concentric lowermost portion of the inner body member 31 and is seated in a closely fitting radially inwardly opening circumferential groove in the outer body member 30.

In being resiliently compressed between the body members 30 and 31, the O-ring 79 serves as a connection through which a limited amount of torque can be transmitted from one to the other of them. The lobe-like bulges 60 on the cap 58 serve as finger grips that facilitate rotation of the picnic coupler 5 about its axis as it is being installed on or removed from a keg. Thus, by a rotational movement of the inner body member 31 in the appropriate direction, through less than half a turn, the bayonet connection 32, 33 between the keg and the outer body member 30 can be established as the O-ring 79 constrains the outer body member to rotate with the inner one; and the slipping of the O-ring 79 enables the cam means 36, 37 to be effective in carrying the inner body member down to its valve unseating position. Removal of the picnic coupler from a keg is of course accomplished by a similar rotational movement of the inner body member 31, but in the opposite direction.

From the foregoing description and the accompanying drawings it will be apparent that this invention provides a very convenient, compact and inexpensive portable keg tapping unit or picnic coupler incorporating a hand pump, which unit can be very easily installed on a keg by a person having no knowledge of keg tapping equipment, is so arranged as to impose no undue forces upon the bayonet connection lugs of the keg, and is further so arranged that its pump, although very easy to operate, nevertheless makes overpressurization of a keg nearly impossible.

What I claim as my invention is:

1. A keg tapping unit for cooperation with a keg that has an upwardly opening wall, lug means projecting radially into said well near the top thereof, an annular gas valve seat at the bottom of said well, an annular gas valve which is biased upwardly for engagement with said gas valve seat and which itself provides a liquid valve seat, and a concentric liquid valve which is biased upwardly for engagement with said liquid valve seat, said tapping unit comprising:

A. a substantially annular outer body member receivable in said well and having
  (1) connection means thereon cooperable with said lug means to provide a bayonet connection and
  (2) annular seal means at the bottom thereof whereby said gas valve seat is sealingly engaged when said bayonet connection is established;

B. an inner body member having a lower portion substantially concentrically received within said outer body member for axial and rotational motion relative thereto and having a substantially concentric upper portion which projects a substantial distance above said outer body member to be accessible for manual rotation, said upper portion being constrained to partake of all motion of said lower portion, and said inner body member having therein
  (1) a liquid passage that opens substantially concentrically to its bottom and
  (2) a gas passage that opens to its bottom in laterally spaced relation to said liquid passage;

C. cooperating cam means on said inner and outer body members whereby rotation in one direction of the inner body member relative to the outer body member moves the inner body member downward to a valve-unseating position;

D. valve unseating means on the bottom of said inner body member, operative when the inner body member is in its valve-unseating position and said bayonet connection is established;
  (1) to hold the liquid valve off its seat and
  (2) to maintain sealing engagement with the gas valve, all around the same, while holding it off its seat;

and

E. an elastic sealing ring confined between said body members to provide a gas seal between them and a frictional connection through which limited torque is transmitted from the inner body member to the outer body member to enable said bayonet connection to be established and subsequent unseating of said gas and liquid valves to be effected by a rotational movement of the inner body member in said one direction.

2. The keg tapping unit of claim 1, further characterized by:

said inner body member having its upper portion concentric with said lower portion and of substantially larger diameter to be conveniently grasped for imparting rotation to the inner body member.

3. The keg tapping unit of claim 2 wherein said upper portion of the inner body member comprises an upwardly opening cup-shaped cylindrical pump chamber to which said gas passage opens upwardly, further characterized by:

(1) a plunger coaxially reciprocable in said pump chamber to cooperate therewith for pumping air downward through said gas passage; and
(2) spring means in said pump chamber biasing said plunger upwardly so that it can be operated by application of intermittent downward force.

4. The keg tapping unit of claim 3, wherein said cooperating cam means comprises a cam follower lug on one of said body members engaged in a cam groove in a cylindrical surface of the other of said body members, which cam groove, along most of its length, extends circumferentially at a spiral inclination in one axial direction, further characterized by:

an end portion of said groove, entered by said cam follower lug when the inner body member is in its valve-unseating position, having a small inclination in the opposite axial direction to define a detent which resists rotation of the inner body member that carries it away from said position.

5. A keg tapping unit for cooperation with a keg unit that is installed in a keg opening and comprises a gas valve and a liquid valve, each biased upwardly to a normally closed position, said keg tapping unit comprising an annular outer body member having connection means thereon for engagement with cooperating connection means on a keg unit to establish a bayonet connection whereby the tapping unit is detachably coupled to the keg unit, and an inner body member having therein a gas passage and a liquid passage that open to its bottom and having its bottom portion formed to engage the gas valve and the liquid valve to hold them open when said bayonet connection is established and the inner body member is in a lowered position relative to the outer body member, said keg tapping unit being characterized by:

A. said inner body member (1) being substantially concentrically rotatable as well as movable up and down relative to said outer body member and (2) having an upper portion which is constrained to partake of all motion of its lower portion and which projects a substantial distance above said outer body member to be accessible for manual rotation;

B. said outer body member having annular gas seal means at the bottom thereof for cooperation with a keg unit to provide a seal between the keg unit and the tapping unit when said bayonet connection is established;

C. cooperating cam means on said inner and outer body members whereby rotation in one direction of the inner body member relative to the outer body member moves the inner body member down to its lowered position; and D. an elastic sealing ring confined between said inner and outer body members to provide a gas seal between them and a frictional connection through which limited torque is transmitted from the inner body member to the outer body member to enable said bayonet connection to be established and subsequent opening of said gas and liquid valves to be effected by rotation of said inner body member in said one direction.

6. The keg tapping unit of claim 5, further characterized by:

E. said upper portion of the inner body member being substantially larger in diameter than said outer body member and defining an upwardly opening cylindrical pump chamber to which said gas passage opens upwardly; and F. a plunger coaxially reciprocable in said pump chamber and biased upwardly towards a position projecting above the pump chamber to be accessible for actuation to pump air downward through said gas passage.

7. The keg tapping unit of claim 6, further characterized by:

G. said liquid passage also opening laterally to one side of said inner body member at a portion thereof that is above the outer body member and below said pump chamber.

8. A portable keg tapping unit for cooperation with a keg that has an upwardly opening well, lug means projecting radially into said well near the top thereof, an annular gas valve seat at the bottom of said well, an annular gas valve which is biased upwardly for engagement with said gas valve seat and which itself provides a liquid valve seat, and a concentric liquid valve which is biased upwardly for engagement with said liquid valve seat, said keg tapping unit comprising:

A. a substantially annular outer body member receivable in said well and having (1) connection means thereon cooperable with said lug means to provide a bayonet connection and (2) annular seal means at the bottom thereof whereby said gas valve seat is sealingly engaged when said bayonet connection is established;

B. an inner body member (1) having a bottom portion concentrically received within said outer body member for axial and rotational motion relative thereto, said bottom portion having therein (a) a liquid passage with one end that opens concentrically to the bottom of said bottom portion and (b) a gas passage with one end that opens to the bottom of said bottom portion in laterally spaced relation to said liquid passage, and (2) having a substantially concentric top portion which is wholly above said outer body member and to one side of which said liquid passage opens at its opposite end, said top portion defining a pump chamber to which an opposite end of said gas passage opens upwardly;

C. cooperating cam means on said inner and outer body members whereby rotation in one direction of the inner body member relative to the outer body member moves the inner body member forward to a valve-unseating position;

D. probe means on the bottom of said inner body member, operative when said bayonet connection is established and the inner body member is in its valve-unseating position (1) to hold the liquid valve off its seat and (2) to maintain sealing engagement with the gas valve, all around the same, while holding it off its seat;

E. an elastic sealing ring confined between the inner and outer body members to provide a gas seal between them and a frictional connection through which limited torque is transmitted from the inner body member to the outer body member to enable said bayonet connection to be established and subsequent unseating of the gas and liquid valves to be effected by a rotational motion of the inner body member in said direction; and F. means cooperable with said pump chamber to comprise a hand pump by which air can be forced through said gas passage into a keg on which the unit is installed.

9. The portable keg tapping unit of claim 8, further characterized by:

(1) said top portion of the inner body member being substantially larger in diameter than said bottom portion to be grasped for rotation of said inner body member; and (2) said pump chamber opening upwardly and having a plunger formed as a piston reciprocable up and down therein and biased upwardly.

10. The keg tapping unit of claim 8, further characterized by:

said cooperating cam means being arranged to provide a detent action as the inner body member arrives at its said position.

* * * * *